US008851843B2

(12) United States Patent
Oh et al.

(10) Patent No.: US 8,851,843 B2
(45) Date of Patent: Oct. 7, 2014

(54) ROTATING BLADE AND AIR FOIL WITH STRUCTURE FOR INCREASING FLOW RATE

(76) Inventors: Myungsoo Oh, Incheon (KR); Sooho Pyo, Okcheon-gun (KR)

( * ) Notice: Subject to any disclaimer, the term of this patent is extended or adjusted under 35 U.S.C. 154(b) by 641 days.

(21) Appl. No.: 13/125,734

(22) PCT Filed: Nov. 6, 2009

(86) PCT No.: PCT/KR2009/006530
§ 371 (c)(1),
(2), (4) Date: Apr. 22, 2011

(87) PCT Pub. No.: WO2010/053317
PCT Pub. Date: May 14, 2010

(65) Prior Publication Data

US 2011/0206514 A1 Aug. 25, 2011

(30) Foreign Application Priority Data

Nov. 6, 2008 (KR) ..... 10-2008-0109618

(51) Int. Cl.
*F03D 11/02* (2006.01)
*F04D 29/38* (2006.01)

(52) U.S. Cl.
CPC ..... *F04D 29/384* (2013.01)
USPC ..... 416/91; 416/241 R

(58) Field of Classification Search
CPC ..... F01D 29/384
USPC ..... 416/90 R, 91, 223 R, 241 R
See application file for complete search history.

(56) References Cited

U.S. PATENT DOCUMENTS

| | | | | |
|---|---|---|---|---|
| 4,886,421 | A * | 12/1989 | Danson | 416/236 R |
| 2010/0209257 | A1* | 8/2010 | Fuglsang et al. | 416/90 R |
| 2010/0260614 | A1* | 10/2010 | Fuglsang et al. | 416/241 R |
| 2011/0229321 | A1* | 9/2011 | Kilaras | 416/1 |

FOREIGN PATENT DOCUMENTS

| | | | |
|---|---|---|---|
| JP | 2006-183598 | A | 7/2006 |
| KR | 20-1989-0003813 | Y1 | 6/1989 |

OTHER PUBLICATIONS

Fluid Kinematics, Professor Fred Stern, 2013, pp. 18-19.*
International Search Report of PCT/KR2009/006530 dated on May 26, 2010.
An Office Action from Korean Intellectual Property Office dated on Feb. 27, 2010.

* cited by examiner

*Primary Examiner* — Ned Landrum
*Assistant Examiner* — Woody A Lee, Jr.
(74) *Attorney, Agent, or Firm* — Im IP Law PLLC; C. Andrew Im

(57) ABSTRACT

According to one embodiment of the present invention, a rotating blade, having a collision face that collides with fluid and is rotated by the flow of said fluid, has at least one flow path that has been caved in from said colliding face; said flow path is located forward with respect to said rotation direction so that it is located in the rear with respect to the inlet wherein said flow is introduced and said rotation direction, and it has an outlet from which said fluid exits. Here, the cross-sectional area of said inlet may be greater than the cross-sectional area of said outlet. In addition, the cross-sectional area of said inlet may gradually decrease toward said outlet.

10 Claims, 4 Drawing Sheets

(a)

(b)

ROTATING BLADE AND AIR FOIL WITH STRUCTURE FOR INCREASING FLOW RATE

BACKGROUND OF THE INVENTION

1. Field of the Invention

The present invention relates to a rotating blade and an air foil, and more particularly, to a rotating blade and an air foil rotated or lifted by a flow of fluid.

2. Background Art

Wind energy has been used as a source of mechanical power for a long time. Wind power generated by a flow of wind is transmitted to a blade as wind collides with a collision face of the blade, and the wind energy is converted into a mechanical energy while the blade rotates by the wind power. Such a mechanical energy may be converted into an electric energy through a turbine, and in this instance, a conversion efficiency is crucial to the energy conversion.

In order to obtain a great deal of electric energy from the same amount of mechanical energy, it is preferable that the blade has a high energy conversion efficiency. That is, when the initial wind energy is converted into a mechanical energy through the blade, the amount of the mechanical energy obtainable from wind energy of the same power varies according to shapes (or structures) of blades, and the energy conversion efficiency shall be determined according to the amount of obtainable energy.

Meanwhile, when wind flows along the upper face and the lower face of an air foil, a lifting force substantially vertical to a wind flow direction, whereby the lifting force is applied on the air foil. The lifting force can lift the air foil up from the ground. That is, wind power is converted into lifting force, and as described above, in case of the high energy conversion efficiency, a great deal of lifting force can be obtained from wind power of the same power.

DISCLOSURE

Technical Problem

Accordingly, the present invention has been made to solve the above-mentioned problems occurring in the prior arts, and it is an object of the present invention to provide a rotating blade and an air foil, which can be moved by a flow of fluid.

It is another object of the present invention to provide a rotating blade and an air foil, which can provide a high energy conversion efficiency.

The above and other objects, features and advantages of the present invention will be apparent from the following detailed description of the preferred embodiments of the invention in conjunction with the accompanying drawings.

Technical Solution

To accomplish the above object, according to the present invention, there is provided a rotating blade, which has a collision face colliding with fluid and is rotated by a flow of the fluid, including at least one flow path that is caved from the colliding face, wherein the flow path includes an inlet located forward with respect to a rotation direction for inflow of the fluid and an outlet located backward with respect to the rotation direction for outflow of the fluid.

Furthermore, the cross-sectional area of the inlet may be greater than the cross-sectional area of the outlet. Additionally, the cross-sectional area of the inlet gradually decreases toward the outlet.

Moreover, a plurality of the flow paths are disposed, and the flow paths are arranged side by side ranging from an end of the rotating blade to the rotation center of the rotating blade.

In addition, the flow paths are formed in an arc shape around the rotation center of the rotating blade.

In another aspect of the present invention, there is provided an air foil, which has an upper face and a lower face where fluid flows, and, to which a lifting force is applied, including at least one flow path that is caved from the upper face, wherein the flow path includes an inlet located at the front end thereof for inflow of the fluid and an outlet located at the rear end thereof for outflow of the fluid.

Advantageous Effects

The rotating blade according to the present invention has a high energy conversion efficiency. That is, the rotating blade has a high rotational frequency by the flow of fluid, which has a predetermined kinetic energy, such that the mechanical energy generated by the flow of the fluid is increased.

DETAILED DESCRIPTION OF THE PREFERRED EMBODIMENT

Figure 1:
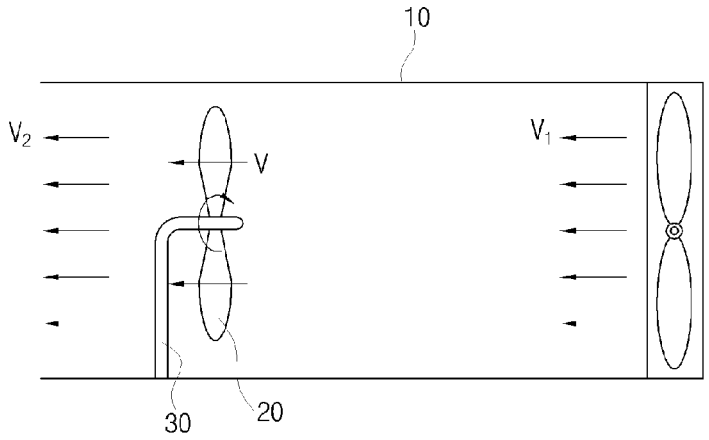
FIG. 1 is a view showing that a propeller is mounted inside a wind tunnel.

Reference will be now made in detail to the preferred embodiments of the present invention with reference to the attached FIGS. 1 to 6. The embodiments of the present invention can be modified in various forms, and the scope of the present invention shall not be restricted to the embodiments, which will be described later. These embodiments are provided to describe this invention in more detail to those skilled in the art. Accordingly, shapes of components illustrated in the drawings can be exaggerated in order to provide more detailed descriptions of the components.

FIG. 1 is a view showing that a propeller is mounted inside a wind tunnel. The wind tunnel 10 is disposed widthwise, and includes a fan mounted at a right side end and an exhaust outlet formed at a left side end. A fluid flow (V1) provided through the fan passes (V) through a propeller 20, and then, goes toward the exhaust outlet (V2).

The propeller 20 is rotatably mounted on a support member 30. The propeller 20 is substantially perpendicular to the wind tunnel 10, and rotates by the fluid flow (V) inside the wind tunnel 10.

Figure 2:
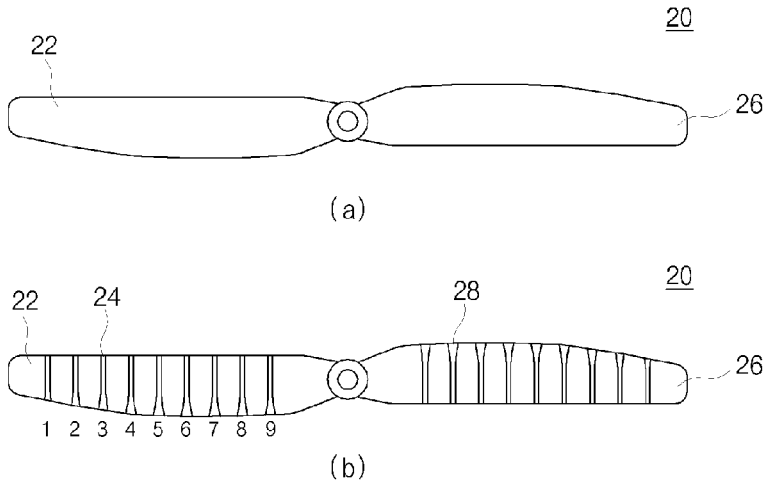
FIG. 2 is a view of a propeller according to a preferred embodiment of the present invention.
Figure 3:
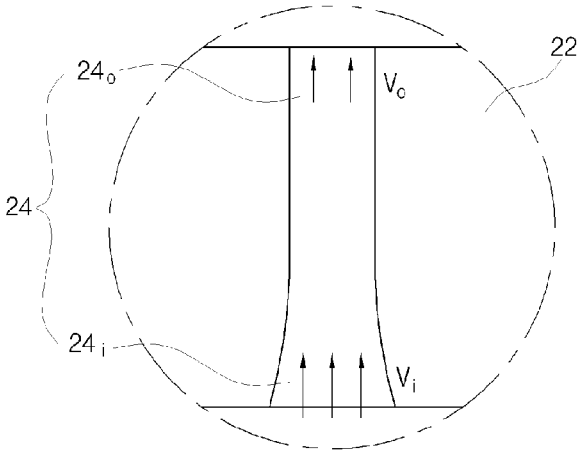
FIGS. 3 and 4 are sectional views of a blade of the propeller of FIG. 2.
Figure 4:
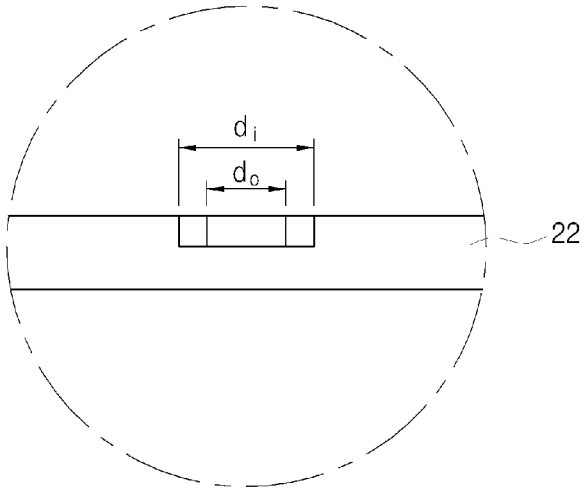

FIG. 2 is a view of a propeller according to a preferred embodiment of the present invention, and FIGS. 3 and 4 are sectional views of a blade of the propeller of FIG. 2.

The propeller 20 includes first and second rotating blades 22 and 26. FIG. 2(*a*) illustrates a propeller 20 according to a prior art, and FIG. 2(*b*) illustrates a propeller according to the preferred embodiment of the present invention. Differently from the propeller 20 according to the prior art, the first and second rotating blades 22 and 26 respectively have a plurality of flow paths 24 and 28. As shown in FIG. 2(*b*), the flow paths 24 and 28 are substantially perpendicular to a longitudinal direction of the rotating blades 22 and 26 and are arranged side by side with each other. The flow paths 24 and 28 are separated apart from each other ranging from ends of the rotating blades 22 and 26 to the rotation center of the rotating blades 22 and 26.

In this instance, as shown in FIG. 3, the flow path 24 has an inlet 24*i* and an outlet 24*o*. The inlet 24*i* is located forward with respect to the rotation direction, and the outlet 24*o* is located backward with respect to the rotation direction. That is, referring to FIG. 2(*b*), the propeller 20 is rotated in the counterclockwise direction, and the inlet 24*i* is formed at the lower portion of the flow path 24 and the outlet 24*o* is formed at the upper portion of the flow path 24.

Moreover, as shown in FIGS. 3 and 4, a width (di) of the inlet 24*i* is larger than a width (do) of the outlet 24*o*. That is, the cross-sectional area of the inlet 24*i* is greater than that of the outlet 24*o*. Furthermore, the cross-sectional area of the inlet 24*i* is gradually decreases toward the outlet 24*o*.

In the meantime, the flow path 28 formed in the second rotating blade 26 is in rotational symmetry relations at an angle of 180 degrees to the flow path 24 formed in the first rotating blade 22. That is, when the first rotating blade 22 is rotated at an angle of 180 degrees on the rotation center, it has the same structure as the second rotating blade 26.

As described above, the fluid flow (V) is formed in the wind tunnel 10 by the fan, and the fluid flow (V) rotates the propeller 20 while colliding with the propeller 20. In this instance, the fluid flow (V) is introduced into the flow path 24 through the inlet 24*i* and goes along the flow path 24, and then, is separated from the flow path 24 via the outlet 24*o*. In this instance, the cross-sectional area of the inlet 24*i* gradually decreases, and hence, a speed (Vo) of the fluid flow (V) measured at the outlet 24*o* is greater than a speed (Vi) of the fluid flow (V) measured at the inlet 24*i*. That is, the fluid flow (V) is accelerated while moving from the inlet 24*i* toward the outlet 24*o*.

Figure 5:
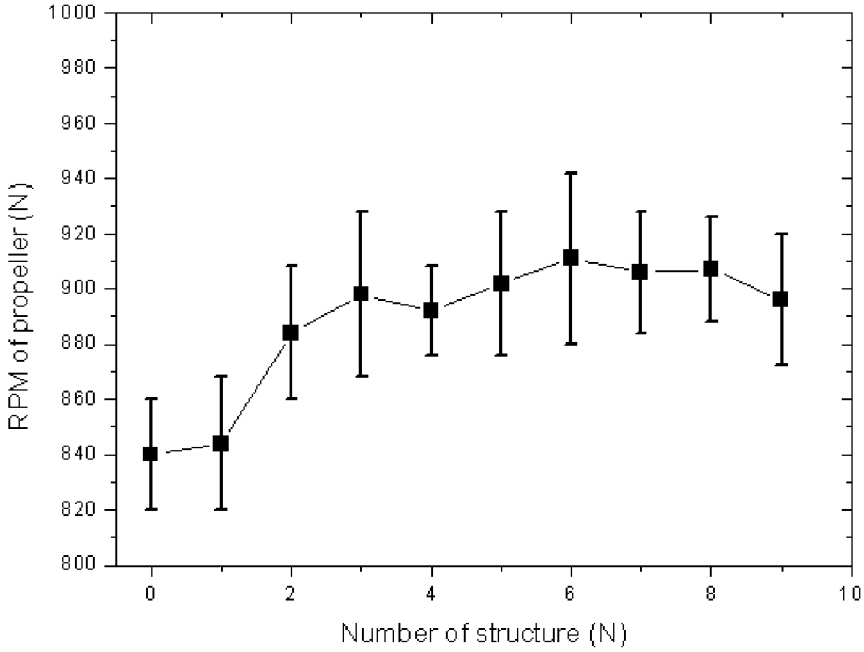
FIGS. 5 and 6 are graphs showing results of tests using the propeller of FIG. 2.
Figure 6:
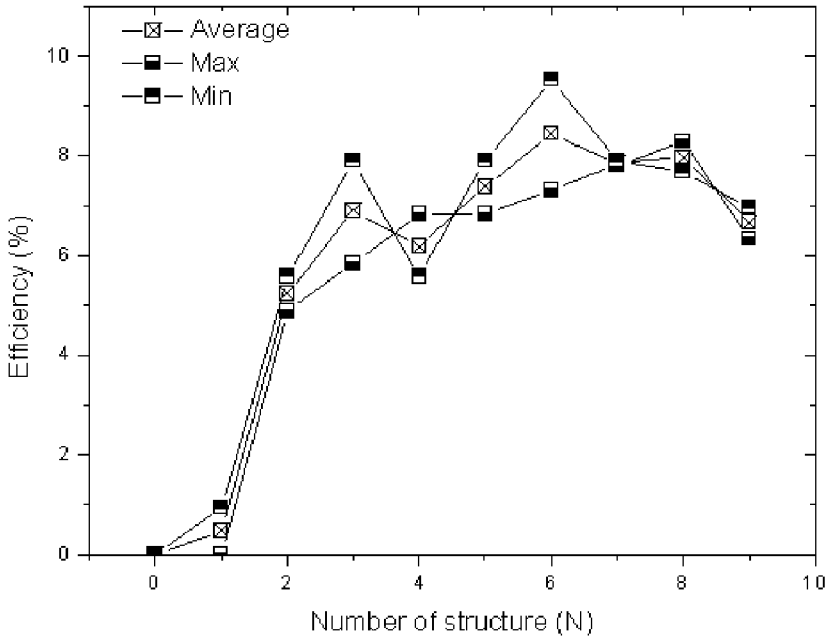

FIGS. 5 and 6 are graphs showing results of tests using the propeller of FIG. 2. First, conditions for tests will be described. The rotational frequency of the fan mounted inside the wind tunnel 10 was set to 1800 rpm and the rotation frequency was kept during the test. Additionally, a distance between the propeller 20 and the fan mounted inside the wind tunnel 10 was about 400 mm.

First, FIG. 5 is a graph showing changes in the rotational frequency of the propeller 20 according to the number of the flow paths 24 and 28 formed in the rotating blades 22 and 26. As shown in FIG. 2(*b*), the flow paths 24 and 28 are formed in order ranging from the ends of the rotating blades 22 and 26 to the rotation center of the rotating blades 22 and 26, for instance, in the case that five flow paths 24 and 28 are formed, Number 1 to Number 5 flow paths 24 and 28 are formed but Number 6 to Number 9 flow paths 24 and 28 are not formed.

Referring to FIG. 5, the rotational frequency is increased more in the case that the flow paths 24 and 28 are formed (N=1, 2, . . . , and 9) than in the case that the flow paths 24 and 28 are not formed (N=0). Especially, in the case that a plurality of the flow paths 24 and 28 are formed (N=2, 3, . . . , and 9), the rotational frequency is increased dramatically. ■ in FIG. 5 means an average value of the measured rotational frequency.

That is, in the case that the flow paths 24 and 28 where the cross-sectional area of the inlet 24*i* is greater than the cross-sectional area of the outlet 24*o* is formed, the rotational efficiency of the propeller 20 increases. The reason is that power of a vector is additionally produced and it increases a rotational force because the speed of the fluid flow (V) on the flow paths 24 and 28 increases.

FIG. 6 is a graph showing changes in the rotational efficiency of the propeller 20 according to the number of the flow paths 24 and 28 formed in the rotating blades 22 and 26. In the same way, as shown in FIG. 2(*b*), the flow paths 24 and 28 are formed in order ranging from the ends of the rotating blades 22 and 26 to the rotation center of the rotating blades 22 and 26, for instance, in the case that five flow paths 24 and 28 are formed, Number 1 to Number 5 flow paths 24 and 28 are formed but Number 6 to Number 9 flow paths 24 and 28 are not formed.

Referring to FIG. 6, the rotational efficiency is increased more in the case that the flow paths 24 and 28 are formed (N=1, 2, . . . , and 9) than in the case that the flow paths 24 and 28 are not formed (N=0). Especially, in the case that a plurality of the flow paths 24 and 28 are formed (N=2, 3, . . . , and 9), the rotational efficiency is increased five to eight times as much as the rotational efficiency in the case that one flow path 24 and 28 is formed.

According to the above, the propeller 20 may have a high energy conversion efficiency. That is, because the predetermined fluid flow (V) is accelerated on the flow path 24 and the rotating blades 22 and 26 have greater rotation speed, a predetermined energy may be converted into greater mechanical energy, and it show the high energy conversion efficiency.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention. The fluid in the present invention includes gas and liquid.

Meanwhile, in this embodiment, the flow paths 24 and 28 are described with sizes of the cross-sectional areas of the inlet 24*i* and the outlet 24*o* as the central figure, but in order to prevent entrance and exit loss (loss due to separation of flow or loss of head) occurring when the fluid flow (V) is introduced into the flow paths 24 and 28, shapes and widths (di and do) of the inlet 24*i* and the outlet 24*o* may be changed. Especially, if the inlet 24*i* and the outlet 24*o* are formed in a streamlined shape, it may minimize a drag force generated relative to the fluid flow (V), and can control the widths (di and do) of the inlet 24*i* and the outlet 24*o* as the speed of the fluid flow (V) increases. Such contents may be applied to the propeller 20, which are previously described, propellers 20, which will be described later, and an air foil 40, which will be described later.

Mode for Invention

Figure 7:
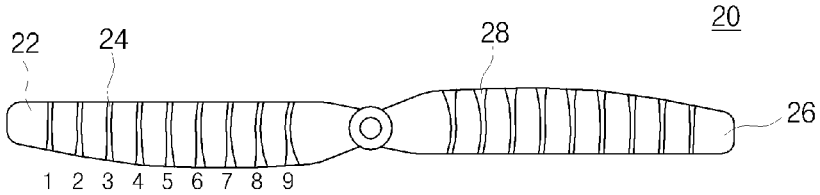
FIG. 7 is a view of a blade according to another preferred embodiment of the present invention.
Figure 7:
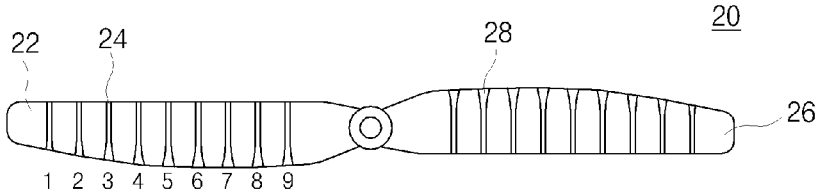

FIG. 7 is a view of a propeller according to another preferred embodiment of the present invention. Differently from the propeller of FIG. 2(*b*), flow paths 24 and 28 may be formed in an arc shape around the rotation center of the propeller 20.

As described above, the rotational efficiency is increased by the flow paths 24 and 28, and especially, the speed of the fluid flow (V) gradually increases while fluid flows from the inlet 24*i*, which is wide, to the outlet 24*o*, which is narrow, and hence, it increases the rotational efficiency.

Figure 8:
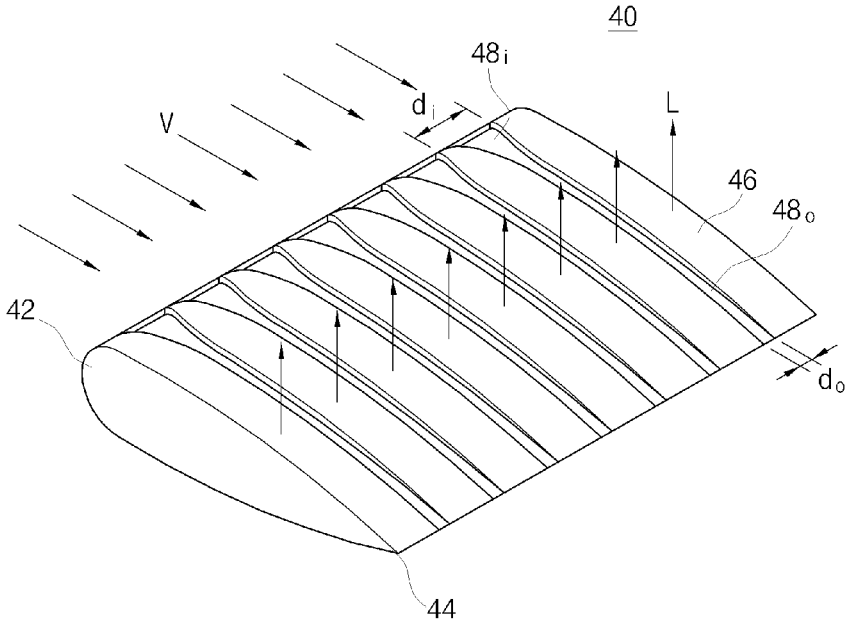
FIG. 8 is a view of an air foil according to a further preferred embodiment of the present invention.

FIG. 8 is a view of an air foil 40 according to a further preferred embodiment of the present invention. As shown in FIG. 8, the air foil 40 has a front end 42 located on the upstream side relative to the fluid flow (V) and a rear end 44 located on the downstream side relative to the fluid flow (V). The fluid flow (V) goes along an upper face 46 and a lower face of the air foil 40 through the front end 42 of the air foil 40, and then, gets out of the air foil 40 through the rear end 44 of the air foil 40.

The air foil 40 includes at least one flow path 48 caved from the upper face 46 thereof, and the flow path 48 has an inlet 48*i* and an outlet 480. The inlet 48*i* is located at the front end 42 of the air foil 40, and the outlet 48*o* is located at the rear end 44 of the air foil 40.

Furthermore, as shown in FIG. 8, the inlet 48*i* is wider than the outlet 480. That is, the cross-sectional area of the inlet 48*i* is greater than the cross-sectional area of the outlet 480. Additionally, the cross-sectional area of the inlet 48*i* gradually decreases toward the outlet 480.

As described above, the fluid flow (V) going along the upper face 46 of the air foil 40 is introduced into the flow path 48 through the inlet 48*i* and goes along the flow path 48, and then, is separated from the flow path 48 through the outlet 480. In this instance, because the cross-sectional area of the inlet 48*i* gradually decreases, the speed of the fluid flow (V) measured at the outlet 48*o* is greater than the speed of the fluid flow (V) measured at the inlet 48*i*. That is, the fluid flow (V) is accelerated from the inlet 48*i* to the outlet 480.

Accordingly, a difference between the speed of the fluid flow (V) going along the upper face 46 of the air foil 40 and the speed of the fluid flow (V) going along the lower face of the air foil 40 grows. Therefore, lifting force (L) applied to the air foil 40 increases.

Because the speed of the fluid speed (V) going along the upper face of the air foil 40 increases by the flow path 48 and speed and pressure are in an inverse relationship according to Bernoulli's equation, a pressure difference between the upper face 46 of the air foil 40 and the lower face of the air foil 40 grows, and the lifting force (L) applied to the air foil 40 increases. Accordingly, a size of the lifting force on the same fluid flow (V) is increased by the flow path 48, and the energy conversion efficiency is also increased by the flow path 48.

Industrial Applicability

The blade and the air foil according to the present invention may be used in various kinds of products.

What is claimed is:

1. A rotating blade colliding with fluid and rotated by a flow of the fluid, comprising: two faces with a leading edge and a trailing edge, a front end located at the leading edge, a rear end located at the trailing edge, and at least one flow path that is caved from one face from the front end of the blade to the rear end of the blade; wherein the flow path includes an inlet located at the front end of the blade which is forward with respect to a rotation direction for inflow of the fluid and an outlet located at the rear end of the blade which is backward with respect to the rotation direction for outflow of the fluid; and wherein a cross-sectional area of the flow path gradually decreases from the inlet to the outlet.

2. The rotating blade according to claim 1, wherein the cross-sectional area of the inlet is greater than the cross-sectional area of the outlet.

3. The rotating blade according to claim 1, wherein a width of the inlet is greater than the width of the outlet.

4. The rotating blade according to one of claims 1 to 3, wherein a plurality of the flow paths are disposed and the flow paths are arranged side by side ranging from an end of the rotating blade to the rotation center of the rotating blade.

5. The rotating blade according to one of claims 1 to 3, wherein the flow paths are formed in an arc shape around the rotation center of the rotating blade.

6. The rotating blade according to claim 1, wherein a fluid flow rate at the outlet is greater than the fluid flow rate at the inlet.

7. An air foil to which a lifting force is applied and where fluid flows, comprising: upper and lower faces with a leading edge and a trailing edge, a front end located at the leading edge, a rear end located at the trailing edge, and at least one flow path that is caved from the upper face from the front end of the air foil to the rear end of the air foil; wherein the flow path includes an inlet located at the front end thereof for inflow of the fluid and an outlet located at the rear end thereof for outflow of the fluid; and wherein a cross-sectional area of the flow path gradually decreases from the inlet to the outlet.

8. The air foil according to claim 7, wherein the cross-sectional area of the inlet is greater than the cross-sectional area of the outlet.

9. The air foil according to claim 7, wherein a width of the inlet is greater than the width of the outlet.

10. The air foil according to claim 7, wherein a fluid flow rate at the outlet is greater than the fluid flow rate at the inlet.

* * * * *